US005195648A

United States Patent [19]

Harris

[11] Patent Number: 5,195,648

[45] Date of Patent: Mar. 23, 1993

[54] MOLDED SNAP-TOGETHER CONNECTOR

[76] Inventor: R. G. Harris, Rte. 7, Box 1200, Thomasville, N.C. 27360

[21] Appl. No.: 781,697

[22] Filed: Oct. 21, 1991

[51] Int. Cl.[5] ..... B65D 43/14

[52] U.S. Cl. ..... 220/343; 220/337; 220/4.23; 220/908; 16/260; 16/253

[58] Field of Search ..... 220/337, 342, 343, 908, 220/4.22, 4.23; 16/250, 251, 253, 260, DIG. 13

[56] References Cited

U.S. PATENT DOCUMENTS

| | | | |
|---|---|---|---|
| 1,467,190 | 9/1923 | Muhlenbruch | 16/253 |
| 3,429,629 | 2/1969 | Cilia | 220/4.22 X |
| 3,936,907 | 2/1976 | Jansons . | |
| 4,086,686 | 5/1978 | Takabayashi | 16/DIG. 13 X |
| 4,282,983 | 8/1981 | Swartzbaugh | 220/335 |
| 4,359,802 | 11/1982 | Röck | 16/251 X |
| 4,384,488 | 5/1983 | Macho . | |
| 4,729,149 | 3/1988 | Brunkan | 16/252 |
| 4,761,852 | 8/1988 | Sauber | 16/251 X |
| 4,787,590 | 11/1988 | Melvin . | |
| 4,847,948 | 7/1989 | Gross et al. | 16/251 |
| 4,908,908 | 3/1990 | Mitsuoka et al. | 16/251 |
| 5,056,192 | 10/1991 | Grass | 16/251 |

FOREIGN PATENT DOCUMENTS

| | | | |
|---|---|---|---|
| 435584 | 5/1967 | Switzerland | 220/343 |
| 447650 | 5/1936 | United Kingdom | 16/251 |

*Primary Examiner*—Allan N. Shoap
*Assistant Examiner*—Stephen Cronin
*Attorney, Agent, or Firm*—Rhodes, Coats & Bennett

[57] ABSTRACT

A molded resilient connector is formed of three components. A first latch receiving component includes at least one row of spaced parallel ribs extending upwardly from a base portion. Each of the ribs has an opening therein with the openings of all ribs in each row being in coaxial registration. A second latching component includes a corresponding row of spaced parallel ears extending downwardly from a support portion. Each ear is provided with a boss extending laterally therefrom. The ribs and ears are formed from a suitable resilient material and so configured and the spacing is such that, when the second component is assembled onto the first component, the bosses of the ears are received within the openings of the adjacent ribs. The first and second components are then retained in relatively secure assembled relationship around the pivot pin. A locking cap comprises a plurality of flanges which extend downwardly from an upper wall into locking relationship between some of the ribs and some of the ears to urge the bosses into seated relation and to limit the subsequent flexure of the ribs and ears.

14 Claims, 4 Drawing Sheets

MOLDED SNAP-TOGETHER CONNECTOR

BACKGROUND AND SUMMARY OF THE INVENTION

The present invention is directed to molded connectors and, more specifically, to a multiple piece connector which, when assembled, securely interconnects two connector members. With the present invention, for example, the molded connector can be assembled around a pivot pin. Alternatively, the connector may be used to join two components such as a wall and door.

In the fabrication of molded articles, it is often necessary to join two members or to attach such items as a hinge bracket to a hinge pin. While appropriately metal hardware is available, it is expensive, usually requires additional fabrication operations, and substantially always requires assembly to the molded components. As a result, the manufacturing costs are increased.

In the construction of covered containers, it is often necessary or desirable to hingedly mount the cover to the container. One example of such containers with hinged covers is in automated garbage and trash collection. During this process, the container is automatically and mechanically lifted and tilted to empty the contents of the container into the collection truck. The container is then lowered and returned to its original resting place. During the entire operation, the cover must be hinged to the container, so that it will open when inverted, and yet remain with the container as it is restored to its original position.

Such operations place an extraordinary amount of stress and strain on the hinge connections. As a result, they must be very strong in order to withstand the continued abuse. On the other hand, such containers are generally formed of molded polymeric materials, and therefore it is desirable for as much of the hinge connection to be molded integrally with the container and/or cover as possible. This presents a problem in developing a molded polymeric connector that is strong and durable, and which is compatible with conventional hinge constructions.

One type of such hinge construction includes a plurality of hinge pins which are journaled between support members molded integrally with one wall of the container. In the past, it has been difficult to mold a connector arm integrally with the cover that is compatible with such a hinge pin, because a one-piece molded construction cannot possibly completely surround the hinge pin. As a result, the connection's joint may not be as strong as possible.

Another example of molded articles to be joined is a molded cabinet with panels or doors, securely attached thereto. Necessary hardware or operations directed toward securing the panels or doors to the cabinet frame are expensive.

In an effort to address this problem, the molded polymeric connector of the present invention is a multi-part member which includes polymeric components that securely interconnect in such a manner as to exhibit the requisite strength, rigidity, and security for maintaining a secure connection while withstanding the extreme strains and stresses to which it would be subjected in service. Furthermore, no loose hardware is required to assemble the components. The assembly operation amounts to merely locating the cooperating parts in proper registration and snapping the same into operative engagement.

In general, the present invention is directed to a molded connector formed of three separate, but interconnecting, parts. A first component molded integrally with a cover member, door, or panel and includes at least one of spaced parallel ribs extending upwardly from a base portion. Each of the ribs includes an opening therein, the openings of the ribs in each row being in coaxial registration.

A second latching component also includes at least one row of spaced parallel ears extending downwardly from a support portion. Each ear is provided with a boss extending laterally from at least one surface thereof.

The ribs and ears are so configured and spaced that, when the second component is assembled onto the first component, the ribs and ears flex to allow the bosses of the ears to be received into the openings of the ribs. The ribs and ears then tend to return to their normal position and the first and second components are retained in assembled relationship around the pivot pin.

A very important feature of the present invention is the locking which securely locks the first and second components together and prevents inadvertent separation thereof. The locking cap includes a plurality of flanges extending downwardly from an upper wall, which flanges are inserted into locking relationship between at least some of adjacent ones of the ribs and ears. So arranged, the bosses are urged into full seated position and flexure of the ribs and ears is limited.

It is therefore an object of the present invention to provide a secure connection of two molded parts without separate hardware.

Another object of the present invention is to provide a connection of the type described in which two molded polymeric members are provided with cooperating ribs and ears which, when assembled, are connected together and further secured by a separate molded locking cap.

A further object of the present invention is to provide a secure connection of the type described in which all of the connector components are molded of resilient polymeric materials.

It is yet another object of the present invention to provide a polymeric connector of the type described which includes a multiple component connection system which is assembled around a pivot pin journaled between two mounting supports.

It is still another object of the present invention to provide a molded polymeric connector of the type described which embodies the requisite security, strength and rigidity for withstanding substantial strains and stresses realized during use.

The invention will become apparent upon reading the following detailed description of a preferred embodiment along with the accompanying drawings in which.

DETAILED DESCRIPTION OF A PREFERRED EMBODIMENT

Figure 1:
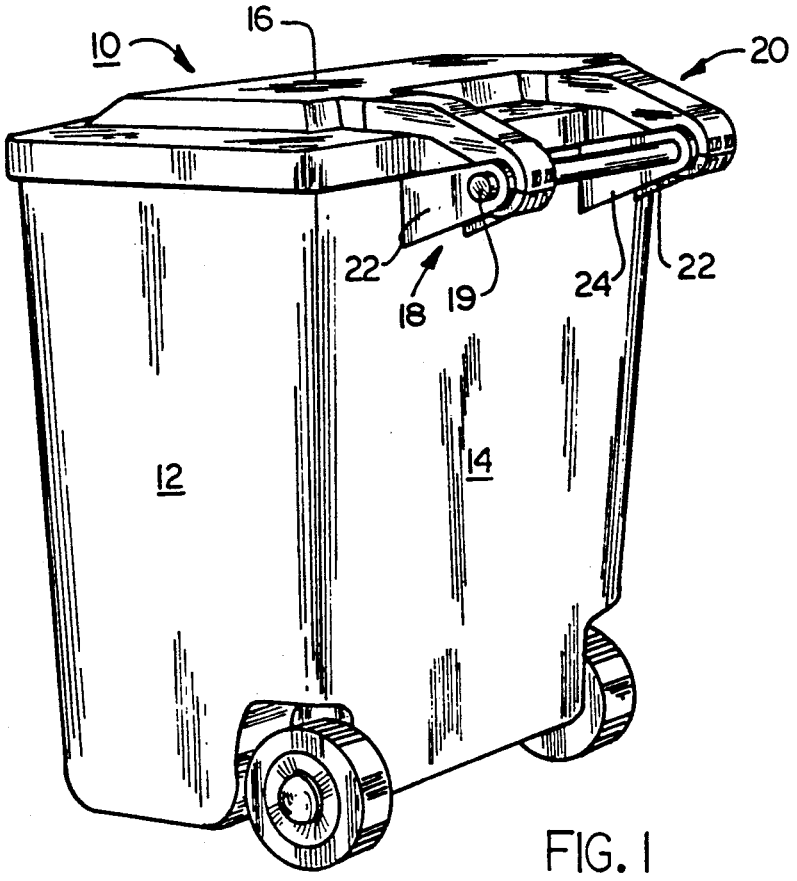
FIG. 1 is a perspective view of a hinged container, illustrating a preferred embodiment of the molded polymeric connector of the present invention applied thereto.

Referring to the drawings, and according to a preferred embodiment, the connector 20 of the present invention is shown integrally molded into lid 16 of a refuse container 10. The refuse container 10 includes side walls 12,14, a bottom wall (not shown) and a cover or lid 16. As illustrated in FIG. 1, at least two mounting brackets 18 are molded integrally with or attached to one of the side walls 14. Each bracket includes a pair of spaced mounting supports 22,24 with a pivot pin 19 journaled therebetween. The connector 20, or at least a major portion thereof, is molded integrally with the cover 16 and extends outwardly and downwardly to a point where it may be assembled around one corresponding pivot pin 19.

Figure 2:
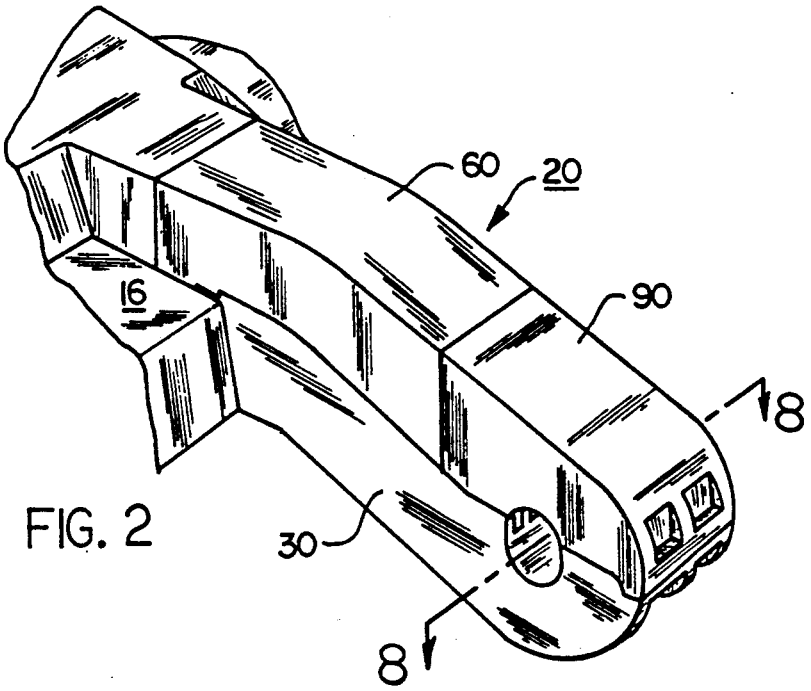
FIG. 2 is an enlarged perspective view, with parts broken away, illustrating the connector member of FIG. 1 assembled around a pivot pin.

Turning now to FIG. 2, it can be seen that the connector 20 is formed of three interconnecting components 30,60,90, one of which (the base latch receiving component 30) is molded integrally with the lid 16. While the invention is described as being applicable to molded polymeric materials, the concepts are also applicable to and the connector may be formed of any resilient material.

Figure 3:
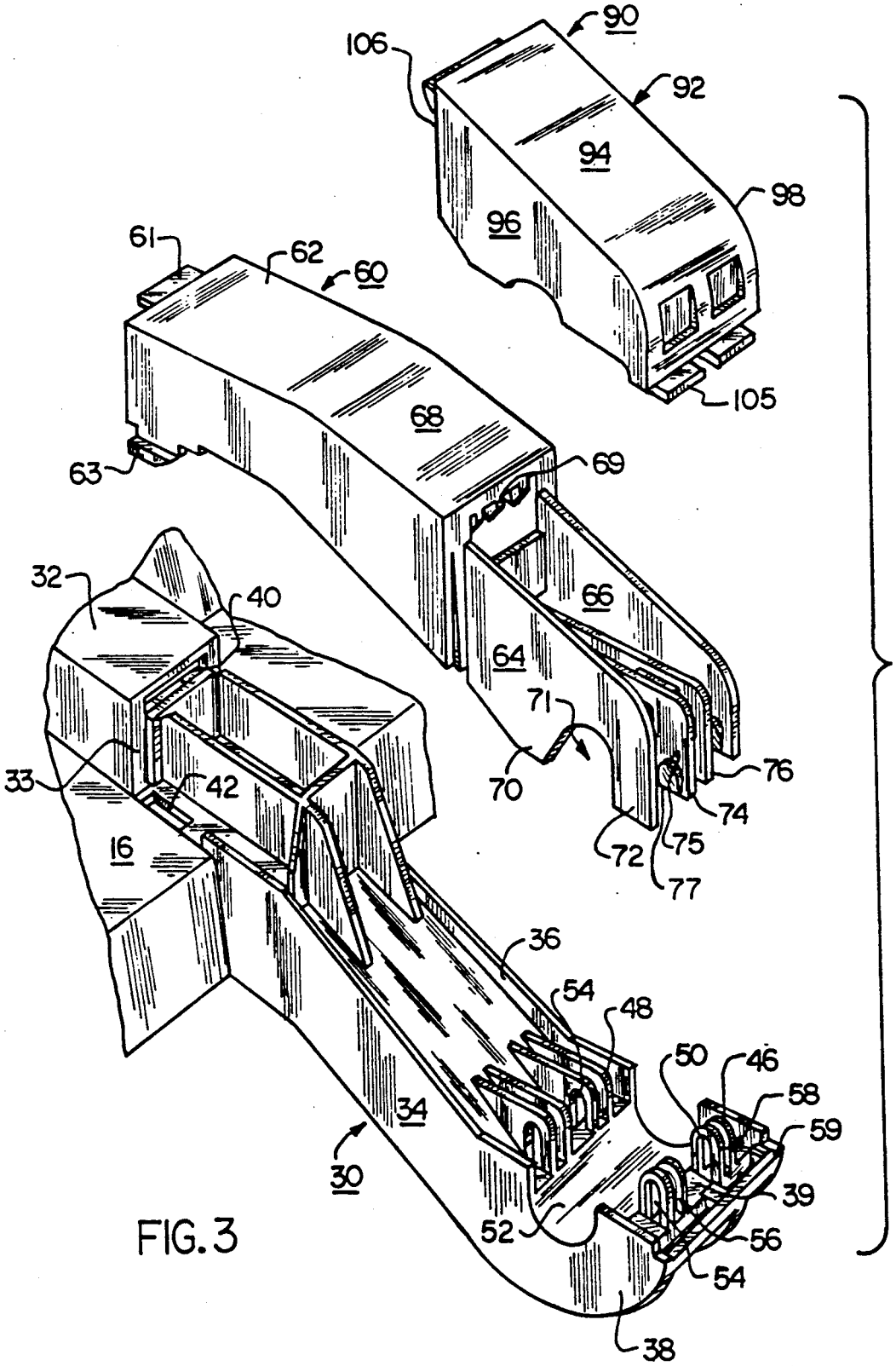
FIG. 3 is an exploded perspective view of the connector member of FIGS. 1 and 2, illustrating the three components thereof in disassembled relationship.
Figure 4:
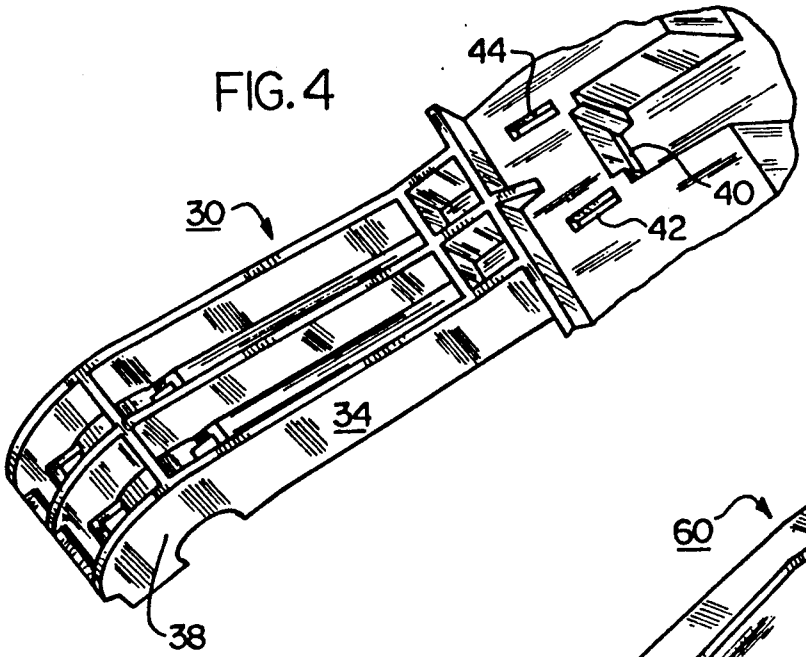
FIG. 4 is a perspective view of the first connector component as seen from the underneath side.
Figure 8:
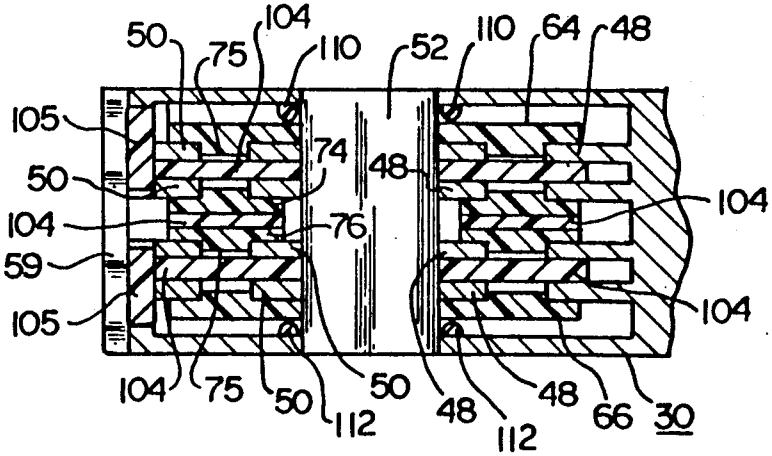
FIG. 8 is a sectional view of the assembled connector looking along lines 8—8 of FIG. 2.

Looking now at FIG. 3, there is illustrated the three connector components 30,60,90 in exploded relationship. Looking first at base component 30 (FIGS. 3 and 4) which is preferably molded integrally with lid 16, the molded structure includes a housing 32 at the upper end from which a pair of arms 34,36 extend downwardly and outwardly at an angle therefrom to support a latch receiving portion 38 at the distal end of arms 34,36. Housing 32 includes a horizontal slot 40 in an upstanding wall 33 thereof. A pair of parallel spaced slots 42,44 are provided in the upper surface of lid 16 at a point near the proximal end of arms 34,36. Slots 40,42,44 receive locking tabs from the second component 60 as will be described hereinafter.

Two rows 46,48 of spaced parallel ribs 50 are provided in upstanding relation to the upper surface 39 of latch receiving portion 38. The two rows 46,48 of ribs 50 are connected by a semicircular seat 52 which forms substantially one-half of a pivot pin receiving seat. Each of the ribs 50 in rows 46,48 includes an opening 54 therein, the openings of the ribs in each row being in coaxial registration for reasons to be described hereinafter.

Looking now more closely at FIG. 3, the ribs 50 in row 46 are arranged in two sets 56,58. In each set, set 56 for example, the ears 50 are closely spaced and parallel. The space between sets 56,58 is greater to provide a rib receiving area therebetween as will be explained hereinafter. A locking bar 59 extends across the extreme distal end and between arms 34,36 for reasons to be described hereinafter. The ribs 50 are molded in such size and configuration and from such a resilient material as to be easily flexed when subjected to a transverse force. When the force is released, however, the ribs 50 return to their original configuration and position because of the memory of the material. In other words, the material from which the ribs, and preferably the entire component 30, are formed should be resilient.

Figure 5:
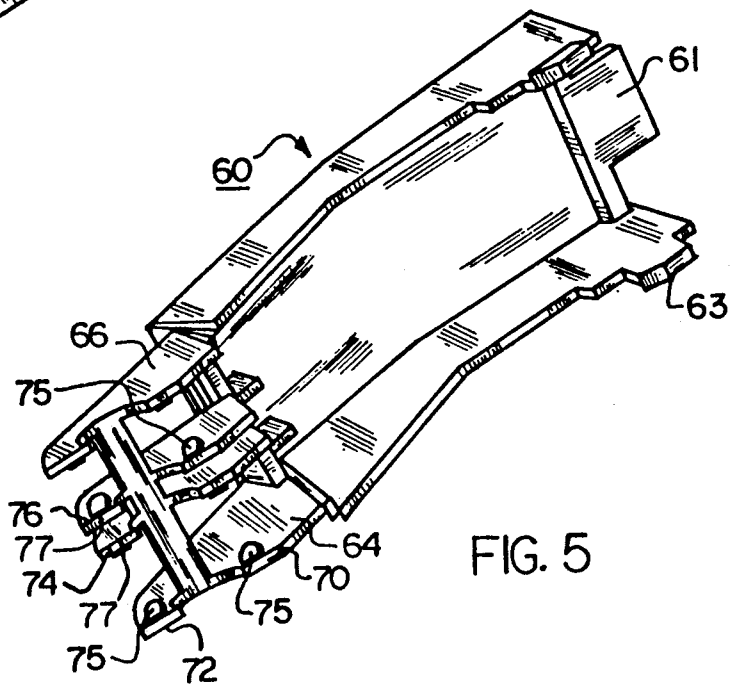
FIG. 5 is a perspective view of the second connector component as seen from the underneath side.

Looking now at the second connector or latching component 60 (FIGS. 3 and 5), a housing 62 is formed by a pair of side walls 64,66 and an upper wall 68 molded together in an inverted U-shaped cross-sectional configuration. At the upper end of housing 62, a horizontally extending tab 61 protrudes rearwardly therefrom for engagement within slot 40 in wall 33. Also, each side wall 64,66 is provided, at the upper end thereof, with downwardly and outwardly extending tabs 63 which are selectively engageable within slots 42,44 in the upper surface of cover 16.

At the lower distal end of housing 62, there are provided two rows of spaced parallel latch members or ears 70,72 extending downwardly therefrom. The outermost ears in each row are actually an extension of side walls 64,66. In addition, there are a pair of spaced, centrally located ears 74,76 in each row. Each of the ears in rows 70,72 include a transversely protruding boss 75 on one surface thereof. The bosses on the outermost ears extend inwardly and the bosses on the centrally located ears 74,76 protrude outwardly. Bosses 75 are so configured as to be received within the openings 54 of ribs 50 in the first connector component 30 when assembled. An inclined or tapered lower portion 77 on each boss facilitates assembly of the bosses 75 into ribs 50. As is the case with ribs 50, the ears 74,76 are formed of a resilient material that facilitates assembly of the two connector components 30,60. The two rows of ears 70,72 include a substantially semicircular area 71 between them which forms the second half of the pivot pin receiving seat therebetween.

The ribs and ears are so configured and spaced that, when the second latching component 60 is assembled onto the first latch receiving component 30, the bosses 75 of each ear therein are received into the openings 54 of the adjacent ribs 50 in the first component 30. Thus, when the two connector components 30,60 are positioned on opposite sides of the aforementioned pivot pin 19 and urged together, the first and second components are latched in assembled relationship with the pivot pin seated therein. The locking tabs 61,63 prevent inadvertent removal of the latching component during use.

Figure 6:
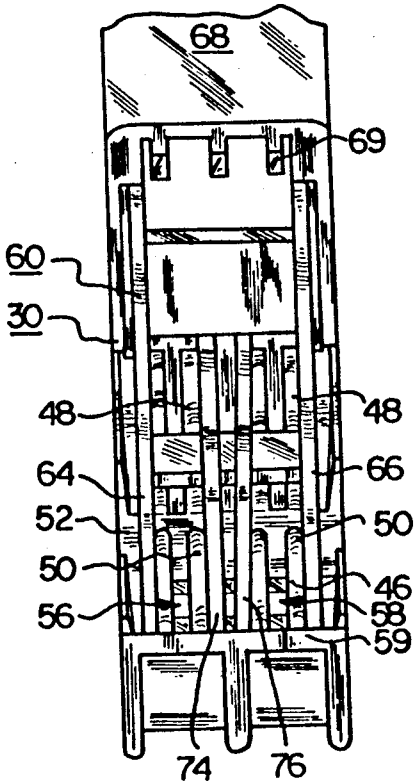
FIG. 6 is a perspective view, looking partially from the front and partially from the top, of the first and second connector components in assembled relationship.

Looking again at FIG. 3, the ears 74,76 and the extremities of side walls 64,66 form two rows 70,72 of ears. As the latching component 60 is employed, the inner surface of the outermost ears engage the outside of the outermost ribs 50 of sets 56,58. At the same time, the inner ears 74,76 are inserted in the innermost ribs 50 of sets 56,58. The resilient construction allows the latching component to be seated adjacent the first component with the bosses 75 of the ears entering the openings 54 in ribs 50. Once the bosses 75 snap into position, the removal therefrom is extremely difficult. It should be noted also that, when assembling the, second component 60 onto the first component, tab 61 is first inserted into slot 40. The housing 62 is then rotated clockwise in FIG. 3 until the tabs 63 enter slots 42,44. Continued downward pressure against the distal end of housing 62 will cause the rows 70,72 of ears to be moved into assembled relationship with ribs 50 as described above and as shown in FIG. 6.

Figure 7:
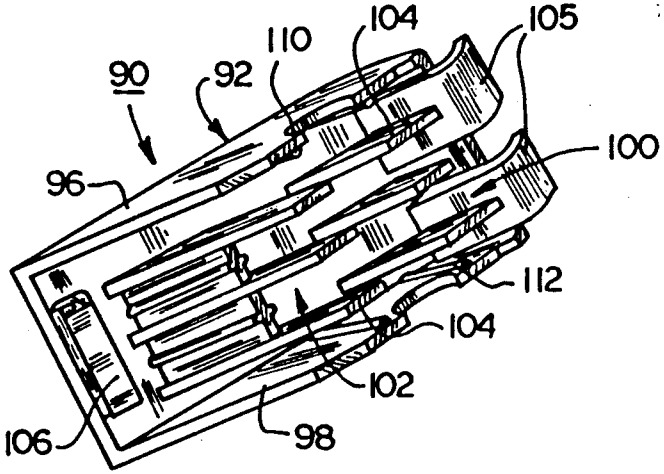
FIG. 7 is a perspective view of the locking cap as seen from the underneath side.

The third component is the locking cap 90 (FIG. 7). Locking cap 90 is aptly named, because it essentially locks the ears and ribs in assembled relation. Locking cap 90 is formed of a housing 92 having an upper wall 94 and side walls 96,98. As seen in FIG. 7, two rows 100,102 of flanges 104 are so configured and spaced that, when assembled onto the assembly of first and second components 30,60, a flange 104 is inserted between the remaining openings between ribs 50 of sets 56,58, and between the ears of the second latching component 60. Walls 96,98 include inwardly protruding splines 110,112 that extend vertically along the surface thereof. When assembled, splines 110,112 apply pressure to the outer surface of walls 64,66 to prevent outward flexure thereof. Once the locking cap 90 is in place, it is essentially impossible for the ears and/or ribs to be flexed sufficiently to release. Housing 90 is also provided with tabs 105,106. Tabs 106 connect housing 92 to the upper wall 68 of housing 62. Tabs 105, in similar manner, engage the locking bar 59 in the first latch receiving component 30. The engagement of these two sets of locking tabs 105,106 prevent removal of the locking cap 90.

So arranged, the assembly is secure and cannot be inadvertently pulled apart. Further, it is almost impossible for unauthorized personnel to separate the components of this assembly. Therefore, in addition to being used as a hinge connector, it may also be used as a locking mechanism for cabinetry.

To assemble the connector 20 of the present invention, the cover 16 with two or more first latch receiving connectors 30 extending therefrom is so positioned that the latch receiving portion 38 is placed into position with the pivot pin 19 resting in the seat portion 52. The latching component 60 is then assembled by inserting tab 61 into slot 40 and moving the member 60 clockwise (as illustrated in FIG. 3) until ears 63,64 snap into place in slots 42,44. At the same time or with slight continued pressure, the lower end of the second latching component 60 is then moved into position with the bosses 75 of the ears snapping into position in the openings 54 of ribs 50. The pivot pin 19 is then held securely between seat 52 and the corresponding seat between rows 70,72 of ears. Finally, the locking cap 90 is assembled over the lower end of the latching hinge component 60 by inserting the tabs 104 beneath the locking bar 59 and rotating housing 92 clockwise, as illustrated in FIG. 3, until the tab 106 snap into place beneath the lower edge 69 of upper wall 68 of housing 62. Once locking cap 90 has been applied in this manner, the connector is substantially impossible to disassemble. The connector is extremely strong and durable and will withstand the continued abuse to which it is subjected during use. Even to an operator who knows the manner in which the assembly is formed, disassembly is almost impossible.

While the preferred embodiment has been described in association with a hinge connector, the concept of the present invention may be applied in other situations. For example, rather than a hinge component, the present invention may be a clasp or connector in which one or more rows of ribs are mounted on one of a side wall or door of a cabinet. One or more rows of ears are then suitably mounted on the other of the side wall or door. When the door is closed, the ribs and ears interconnect and, when the locking member is seated, the cabinet is then essentially locked and maintained from an authorized entry. The only way to enter the cabinet, once the locking cap is emplaced, is to essentially destroy the connector member.

While the invention has been discussed in terms of a preferred embodiment, it is apparent that various changes and modifications might be made to the invention without departing from the scope thereof, which is set forth in the accompanying claims.

What is claimed is:

1. A connector for securing one member to a second member, said connector comprising:

a) a first latch receiving component positioned on one of said members and having at least one row of spaced parallel resilient ribs extending from a base portion each rib including an opening therein, the openings of the ribs in each row being in coaxial registration;

b) a second latching component mounted on the other of said members and having at least one row of spaced parallel resilient ears extending from a support portion, each ear provided with a boss extending laterally from at least one surface thereof;

c) said ribs and ears being so configured and spaced that, when said second latching component is assembled onto said first component, the bosses of said ears are received into the openings of said ribs, whereby said first and second connector components are retained in assembled relationship;

d) a locking cap comprising an upper wall and a plurality of flanges extending downwardly therefrom into locking relationship between at least some of adjacent ones of said ribs and ears, whereby flexure of said ribs and ears is limited.

2. The connector according to claim 1 wherein said at least one row of spaced parallel ribs are arranged in spaced sets, each set including two, parallel, s ribs, and said at least one row of spaced parallel ears are arranged in spaced sets, each of said sets of ears including two ears which, when moved into assembled position, frictionally engage and deflect the outer surfaces of one of said sets of ribs, moving the bosses on said ears into seated relationship in the openings therein.

3. The connector according to claim 2 wherein said first connector component, said second connector component, and said locking cap are all formed of a molded polymeric material.

4. A molded polymeric connector for hingedly mounting one polymeric member to a second member, said second member having suitably mounted thereon a hinge or pivot pin, said connector comprising:

a) a first latch receiving component positioned on one diametrical side of said pivot pin and having two rows of spaced parallel ribs extending upwardly from a base portion, said two rows forming substantially one-half of a pivot pin receiving seat therebetween, each of said ribs having an opening therein, the openings of the ribs in each row being in coaxial registration;

b) a second latching component positioned in one diametrical side of said pivot pin and having two rows of spaced parallel ears extending downwardly from a support portion, each ear provided with a boss extending laterally from at least one surface thereof, said two rows forming substantially the second half of a pivot pin receiving seat therebetween;

c) said ribs and ears being so configured and spaced that, when said second latching component is assembled onto said first component, the bosses of said ears are received into the openings of said ribs, whereby said first and second components are retained in assembled relationship with said pivot pin seated therein.

5. The connector according to claim 4 and further including means for releasably securing said second latching component to said base portion of said first latch receiving component at a position spaced from said ribs and ears, whereby inadvertent removal of said second latching component during use is prevented.

6. The connector according to claim 4 wherein:

a) each of said rows of said parallel ribs are arranged in spaced sets, each set including two parallel spaced ribs;

b) each of said rows of spaced parallel ears are arranged in spaced sets, each set including two ears which, when moved into assembled position frictionally engage and deflect the outer surfaces of one of said sets of ribs, moving the bosses on said ears into seated relationship in the openings therein.

7. The connector according to claim 6 and further including means to releasably secure said second latching component to said base portion of said first latch receiving component at a position spaced from said ribs and ears, whereby inadvertent removal of said second connector component during use is prevented.

8. The connector according to claim 4 and further including a locking cap comprising an upper wall and a plurality of flanges extending downwardly from said upper wall into locking relationship between at least some of adjacent ones of said ribs and ears, whereby flexure of said ribs and ears is limited.

9. The connector according to claim 8 and further including means to secure opposite ends of said upper wall of said locking cap to said first and second components.

10. A container with a hinged cover comprising:

a) said container formed with side walls, a bottom wall, and a polymeric cover member;

b) one of said side walls including at least two mounting brackets, each mounting bracket comprising a pair of spaced mounting supports with a pivot pin journaled therebetween;

c) said cover member having a pair of connector arms molded integrally therewith and extending outwardly thereof;

d) each of said connector arms including:

i) a first latch receiving component positioned on one diametrical side of said pivot pin and having two rows of spaced parallel ribs extending upwardly from a base portion, said two rows forming substantially one-half of a pivot pin receiving seat therebetween, each of said ribs having an opening therein, the openings of the ribs in each row being in coaxial registration;

ii) a second latching component positioned on the, other side of said pivot pin and having two rows of spaced parallel ears extending downwardly from a support portion, each ear provided with a boss extending laterally from at least one surface thereon, said two rows forming substantially the second half of a pivot pin receiving seat therebetween;

iii) said ribs and ears being so configured and spaced that, when said second latching component is assembled onto said first latch receiving component, the bosses of said ears are received into the openings of said ribs, whereby said first and second components are retained in assembled relationship with said pivot pin seated therein.

11. The container according to claim 10 and further including means for releasably securing said second latching component to said base portion of said first latch receiving component at a position spaced from said ribs and ears, whereby inadvertent removal of said second latching component during use is prevented.

12. The container according to claim 10 wherein:

a) each of said rows of said parallel ribs are arranged in spaced sets, each set including two parallel spaced ribs;

b) each of said rows of spaced parallel ears are arranged in spaced sets, each set including two ears which, when moved into assembled position frictionally engage and deflect the outer surfaces of one of said sets of ribs, moving the bosses on said ears into seated relationship in the openings therein.

13. The container according to claim 10 and further including a locking cap comprising an upper wall and a plurality of flanges extending downwardly from said upper wall locking relationship between at least some of adjacent ones of said ribs and ears, whereby flexure of said ribs and ears is limited.

14. The container according to claim 13 and further including means to secure opposite ends of said upper wall of said locking cap to said first and second components.

* * * * *